US008093525B2

(12) United States Patent
Altmann

(10) Patent No.: US 8,093,525 B2
(45) Date of Patent: Jan. 10, 2012

(54) REDUNDANT SWITCH

(75) Inventor: Markus Altmann, Moos-Bankholzen (DE)

(73) Assignee: TRW Automotive Electronics & Components GmbH, Radolfzell (DE)

( * ) Notice: Subject to any disclaimer, the term of this patent is extended or adjusted under 35 U.S.C. 154(b) by 464 days.

(21) Appl. No.: 12/322,564

(22) Filed: Feb. 4, 2009

(65) Prior Publication Data

US 2009/0205940 A1 Aug. 20, 2009

(30) Foreign Application Priority Data

Feb. 14, 2008 (DE) ..... 20 2008 002 002 U

(51) Int. Cl.
*H01H 15/00* (2006.01)

(52) U.S. Cl. ..... 200/537

(58) Field of Classification Search ..... 200/537, 200/16 R, 547, 549, 550
See application file for complete search history.

(56) References Cited

U.S. PATENT DOCUMENTS

| | | | |
|---|---|---|---|
| 2,968,710 | A | 11/1958 | Horberg, Jr. |
| 5,534,672 | A | 7/1996 | Meagher |

FOREIGN PATENT DOCUMENTS

| | | |
|---|---|---|
| EP | 1853047 | 12/2007 |
| JP | 56057439 | 5/1981 |
| JP | 02044223 | 3/1990 |
| JP | 06077123 | 10/1994 |

*Primary Examiner* — Vanessa Girardi
(74) *Attorney, Agent, or Firm* — Tarolli, Sundheim, Covell & Tummino LLP

(57) ABSTRACT

A redundant switch includes a housing, an actuator, and a slide movable in the housing in two opposing directions. The slide is coupled to the actuator by two antagonistic springs. The switch includes a latching track with latching notches. At least two switch units are arranged one beside the other for simultaneous actuation by the slide. A latching cam is movably guided on the slide and is urged towards the latching track by a compression spring. The antagonistic springs force the slide to move into respective positions when the latching cam slides over an apex between the latching notches.

5 Claims, 9 Drawing Sheets

REDUNDANT SWITCH

FIELD OF THE INVENTION

This invention relates to a redundant switch, in particular for actuating an electric parking brake in vehicles.

BACKGROUND OF THE INVENTION

Safety-relevant switching functions in vehicles require redundancy. Redundancy is achieved in that for the same switching function at least two switching units are present in parallel, which are actuated at the same time. Electronic control circuits monitor the switching signals. If the redundant switching signals are not detected within a predetermined period of, for instance, 30 ms, an error is indicated.

In practice, the implementation of redundant switches places high demands on the mechanical precision. To ensure the actuation of the redundant switch units within a very short period, actuator and switch units must be aligned relative to each other very precisely. Nevertheless, it is possible that instead of several switch units only one of them is actuated, for instance when the actuator is blocked in its actuating stroke.

The invention resolves this problem with a redundant switch, which does not place high demands on the mechanical precision and nevertheless ensures a safe actuation of the redundant switch units within a very short period.

SUMMARY

The redundant switch of the invention has a housing and an actuator arranged for translational movement in the housing in two opposing directions. The actuator can include a handle, button or the like for the direct manual actuation. The switch furthermore has a slide, which is movable in the housing in the same two opposing translational directions as the actuator and is coupled with the actuator by two antagonistic springs with clearance in both directions of movement. The slide thus is moved by the actuator either directly by contact with the actuator or indirectly by the action of one of the two antagonistic springs. On the housing, a latching track is formed with at least two latching notches, which are spaced from each other along the directions of movement. At least two switch units are arranged in the housing one beside the other for simultaneous actuation by the slide. Furthermore, a latching cam is disposed on the slide, which is movably guided vertical to the directions of movement of the slide and is urged in the direction of the latching curve by a compression spring. In cooperation with the latching cam, one of the latching notches of the latching track defines a rest position of the slide, in which the slide does not actuate the switch units. In cooperation with the latching cam, another latching notch defines an actuating position of the slide, in which the slide has actuated the switch units. Upon actuation of the slide, one of the two antagonistic springs is tensioned, whereas the other one is relaxed, until the actuator directly urges against the slide. As a result of the further movement of the actuator, the slide then is moved from its rest position in the direction of the actuating position, wherein the latching cam backs away by moving up along the ramp of the latching notch against its spring load. As soon as the latching cam reaches the apex between the adjacent latching notches, the tensioned spring starts to act and moves the slide with a forced movement into its actuating position, in which the latching cam snaps into place at the bottom of the adjacent latching notch. The actuation of the redundant switch units now is effected in the course of this forced movement. On the one hand, the forced movement can be effected very quickly, as it is initiated by the tensioned spring alone. On the other hand, the forced actuating movement of the slide cannot be prevented by a blocked or locked actuator, as actuator and slide are not directly coupled with each other.

In the preferred embodiment, the apex between the two adjacent latching notches of the latching track is flattened. The latching cam on the slide thus slides over a flat surface region between the latching notches under the influence of the tensioned spring. The slide and the switch units now are arranged relative to each other such that the actuation of the switch units by the slide is effected in the course of the sliding movement of the latching cam over the flattened or flat surface between the latching notches. Since this sliding movement of the slide is unimpeded and effected quickly, structural or mounting tolerances cannot prevent the switch units from being actuated within a very short period.

If two switching functions are required, the switch is constructed mirror-symmetrically with respect to a middle plane extending through the rest position of the slide. The latching track then has a latching notch for the rest position and, on both sides of the latching notch for the rest position, one latching notch each for an actuating position of the slide.

Further features and advantages of the invention can be taken from the following description of a preferred embodiment with reference to the attached drawings, in which:

DETAILED DESCRIPTION OF AN EXEMPLARY EMBODIMENT

Figure 9:
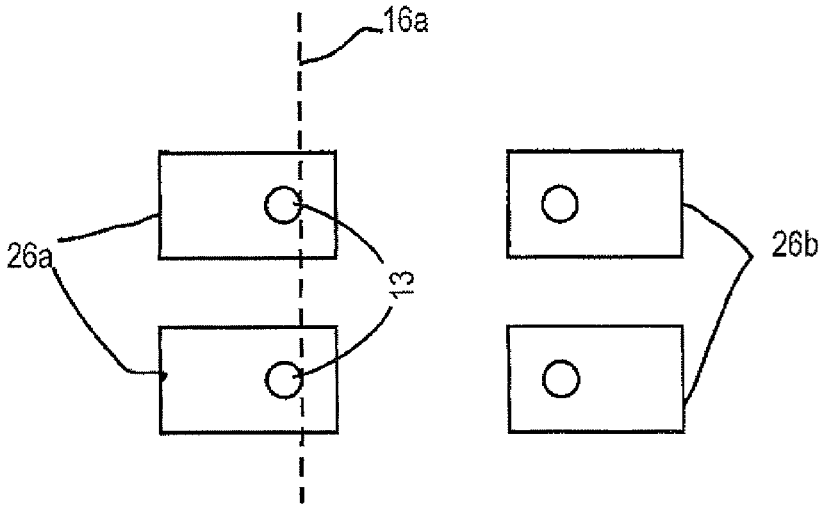
FIG. 9 shows schematically the arrangement of multiple switch units.

The switch has a housing, of which only the bottom 10 is schematically shown in the Figures. In the housing, an actuator 12 is guided for a linear translational movement. The actuator 12 has a rectangular window-like recess 14. In this recess 14, a slide 16 is accommodated with play on all sides, which is linearly movable in the same translational directions of movement as the actuator 12. On the inside of the bottom 10, a latching track 18 is formed in opposition to the slide 16. The latching track 18 has three latching notches, which are spaced from each other in the direction of movement of the slide 16. In a bore perpendicular to the direction of movement of the slide 16, a spring-loaded piston 20 is movably guided, which has a latching cam 22 at its outer end facing the latching track 18. The slide 16 has two actuating ramps 16*a*, 16*b* on its side facing away from the latching track 18, which faces a circuit board 24 on which two groups of switch units 26*a* and 26*b* are mounted. The switch units 26*a*, 26*b* are common microswitches, which each include an actuating tappet 13. Each group of switch units 26*a*, 26*b* comprises at least two microswitches arranged one beside the other in parallel, which via their actuating tappets are actuated in parallel by the actuating ramps 16*a* and 16*b*, respectively. This arrangement is shown schematically in FIG. 9. Due to the parallel arrangement of the microswitches on the circuit board 24, the side views of the drawings only show one switch unit of each group of switches.

Figure 1:
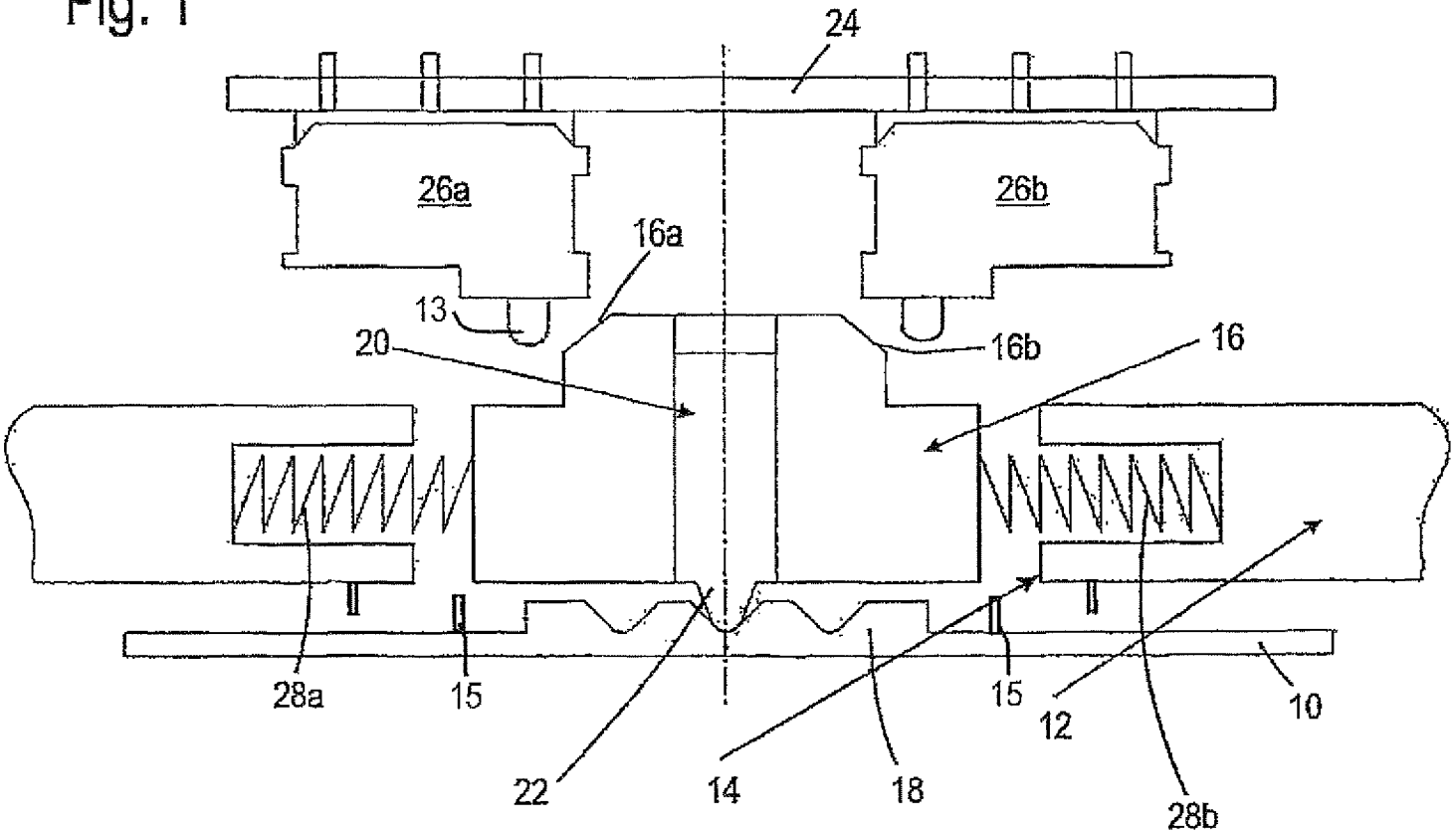
FIG. 1 shows a schematic cross-sectional side view of the redundant switch according to an embodiment of the invention in the rest position.

FIG. 1 shows the redundant switch in the non-actuated condition. The slide is supported on the actuator 12 by two antagonistic pretensioned compression springs 28*a*, 28*b*. The latching cam 22 is snapped into place at the bottom of the middle latching notch of the latching track 18 and holds the slide 16 in a center position relative to the actuator 12, with equal play with respect to the actuator 12 on both sides of the slide 16. In this non-actuated position, the actuating ramps 16*a*, 16*b* are spaced from the actuating tappets 13 of the associated switch units 26*a*, 26*b* and the switch units are non-actuated.

Figure 2:
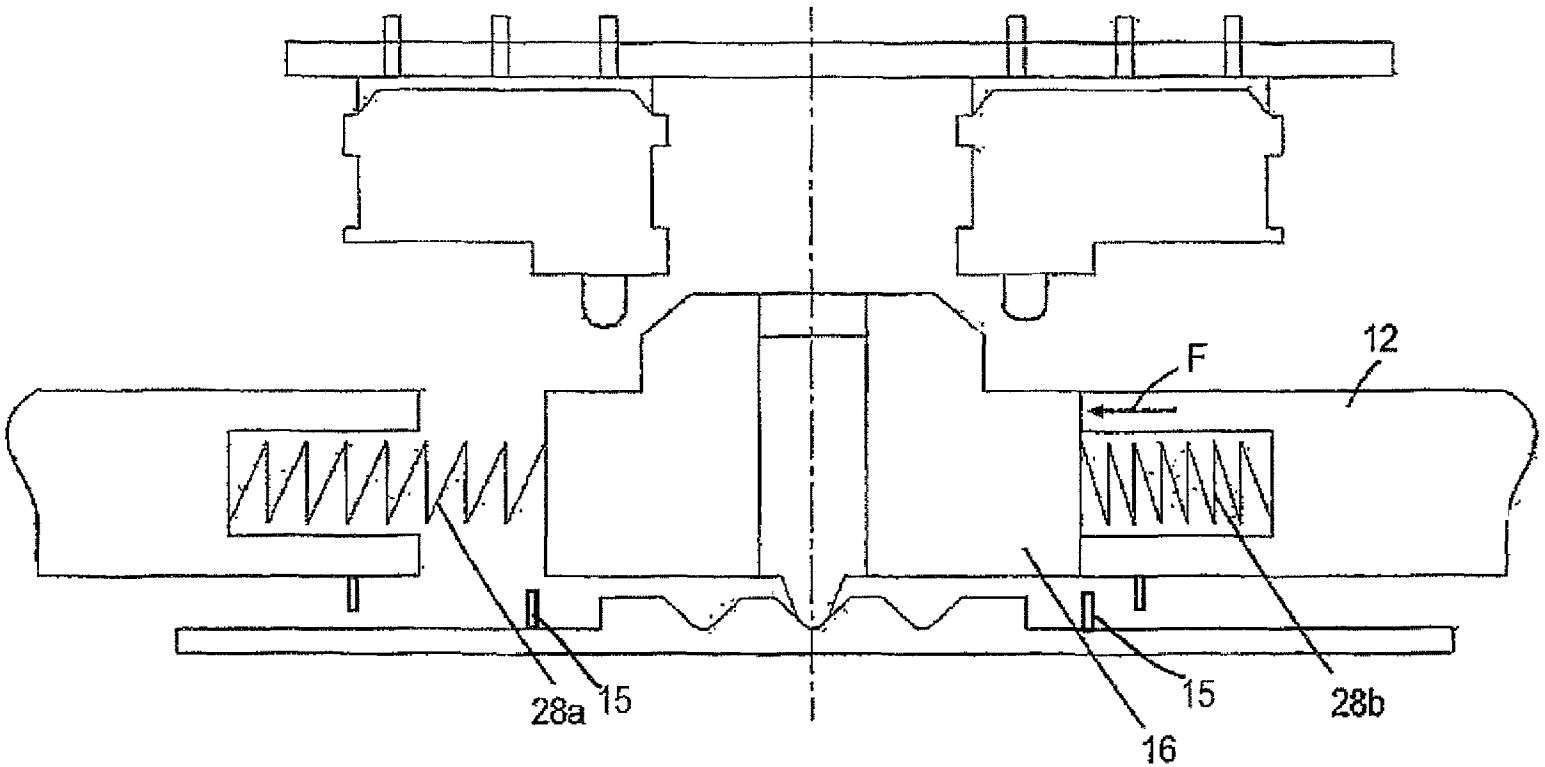
FIG. 2 shows a schematic cross-sectional side view of the redundant switch according to FIG. 1 in the rest position after applying an activating force.
Figure 3:
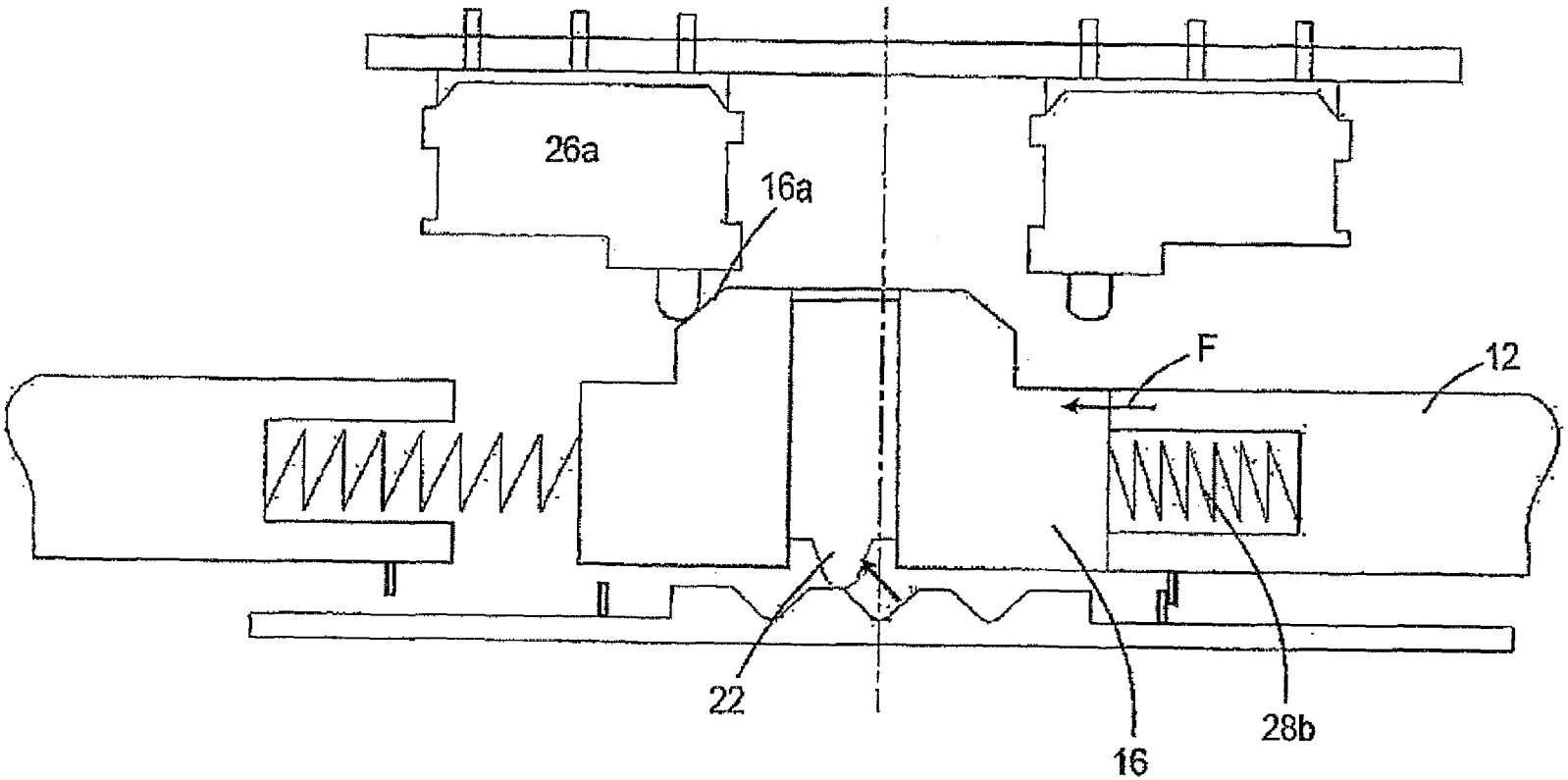
FIG. 3 shows a schematic cross-sectional side view of the redundant switch according to FIG. 1 when switching starts.

If a force is now exerted on the actuator 12 in the direction of an arrow F, as shown in FIG. 2, the compression spring 28*b* is first compressed, whereas the compression spring 28*a* is relaxed, until the actuator 12 abuts against the slide 16. With increasing force F, as shown in FIG. 3, the actuator 12 directly urges against the slide 16 and displaces the same in the direction of the force F, wherein the latching cam is lifted and moves up along the ramp of the middle latching notch. As soon as the latching cam 22 has reached the apex between the two adjacent latching notches, it freely and unimpededly slides over the flat apex surface under the influence of the tensioned compression spring 28*b*, also independent of the further action of the force F. During this forced movement of the slide 16, the actuating ramp 16*a* runs onto the actuating tappet of the switch units 26*a* and actuates the same. The path of movement of the slide 16 for actuating the switch units is uncritical, as the entire flattened apex region between the latching notches is available as actuating path. The actuator 12 now abuts against a fixed stop 15 on the housing, so that the further movement of the slide 16 in the direction of the adjacent latching notch is effected under the influence of the tensioned compression spring 28*b* alone. Although the stop 15 is shown schematically in the drawings it will be appreciated that the stop may exhibit alternative configurations.

Figure 4:
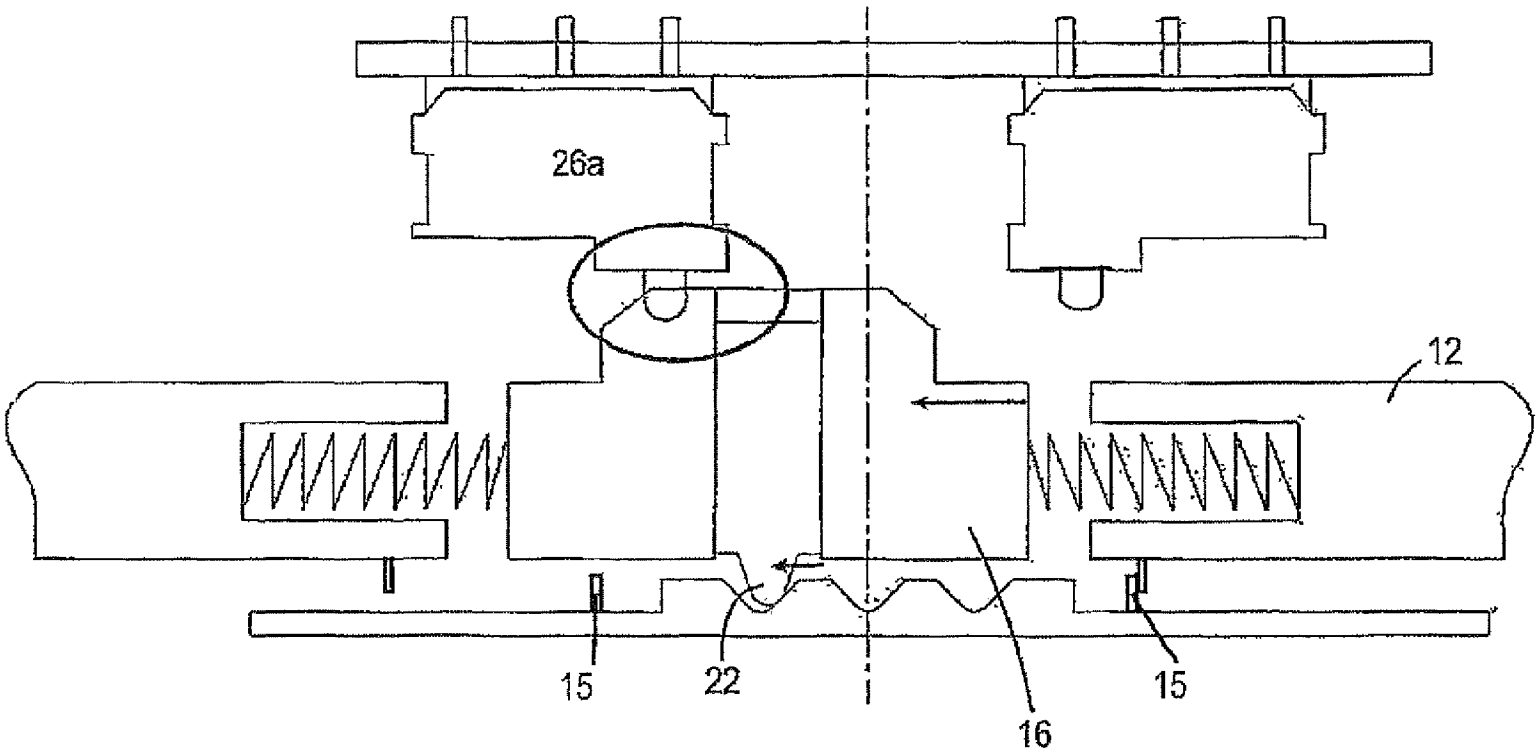
FIG. 4 shows a schematic cross-sectional side view of the redundant switch according to FIG. 1 when a cam snaps into an adjacent latching notch.
Figure 5:
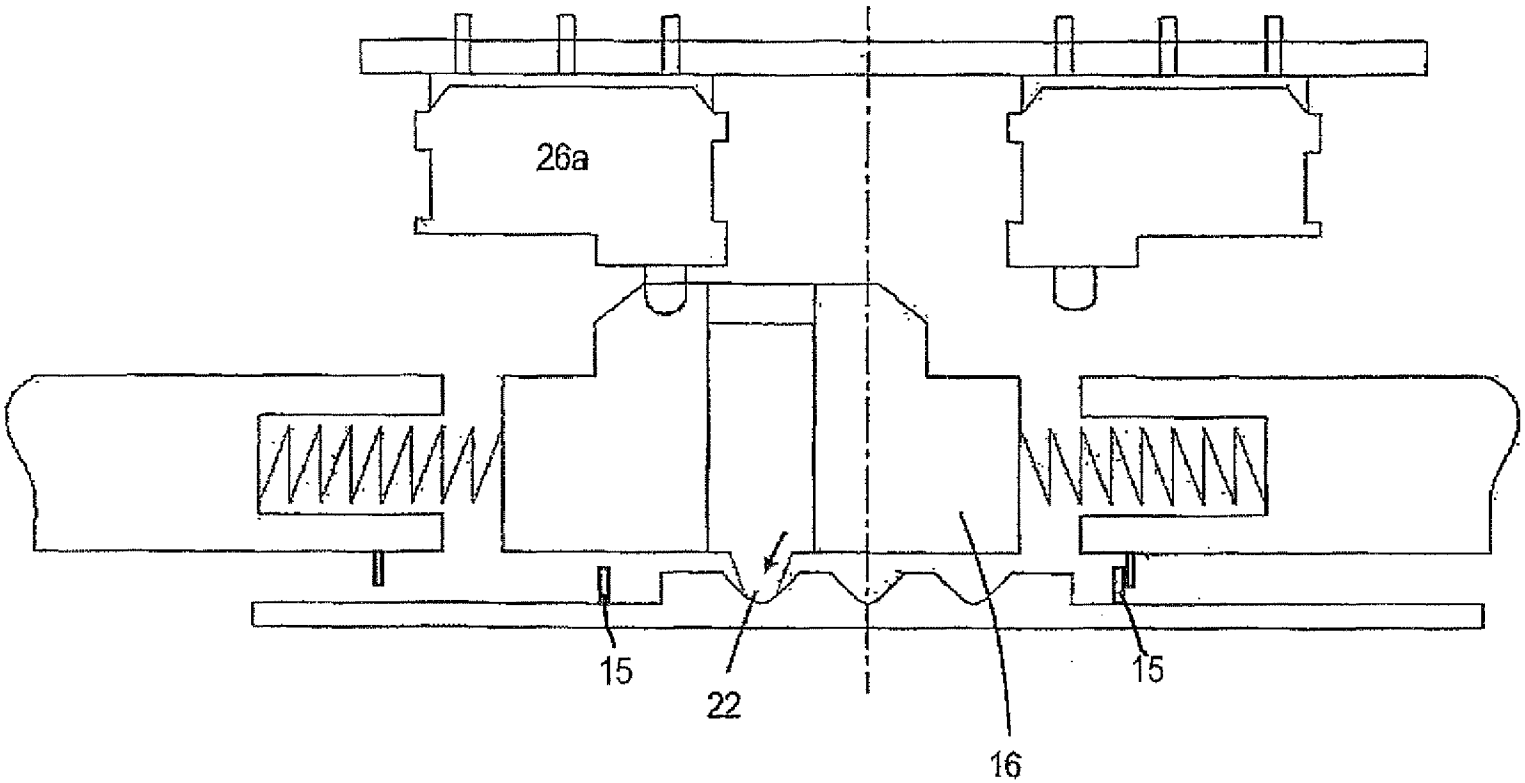
FIG. 5 shows a schematic cross-sectional side view of the redundant switch according to FIG. 1 in an actuating position.

As shown in FIG. 4, the latching cam 22 then snaps into the adjacent latching notch, wherein the slide 16 has separated from the actuator 12, which still remains at the stop of the housing. As soon as the latching cam 22 has completely snapped into the latching notch, as shown in FIG. 5, the slide 16 is in the one of its two actuating positions.

Figure 6:
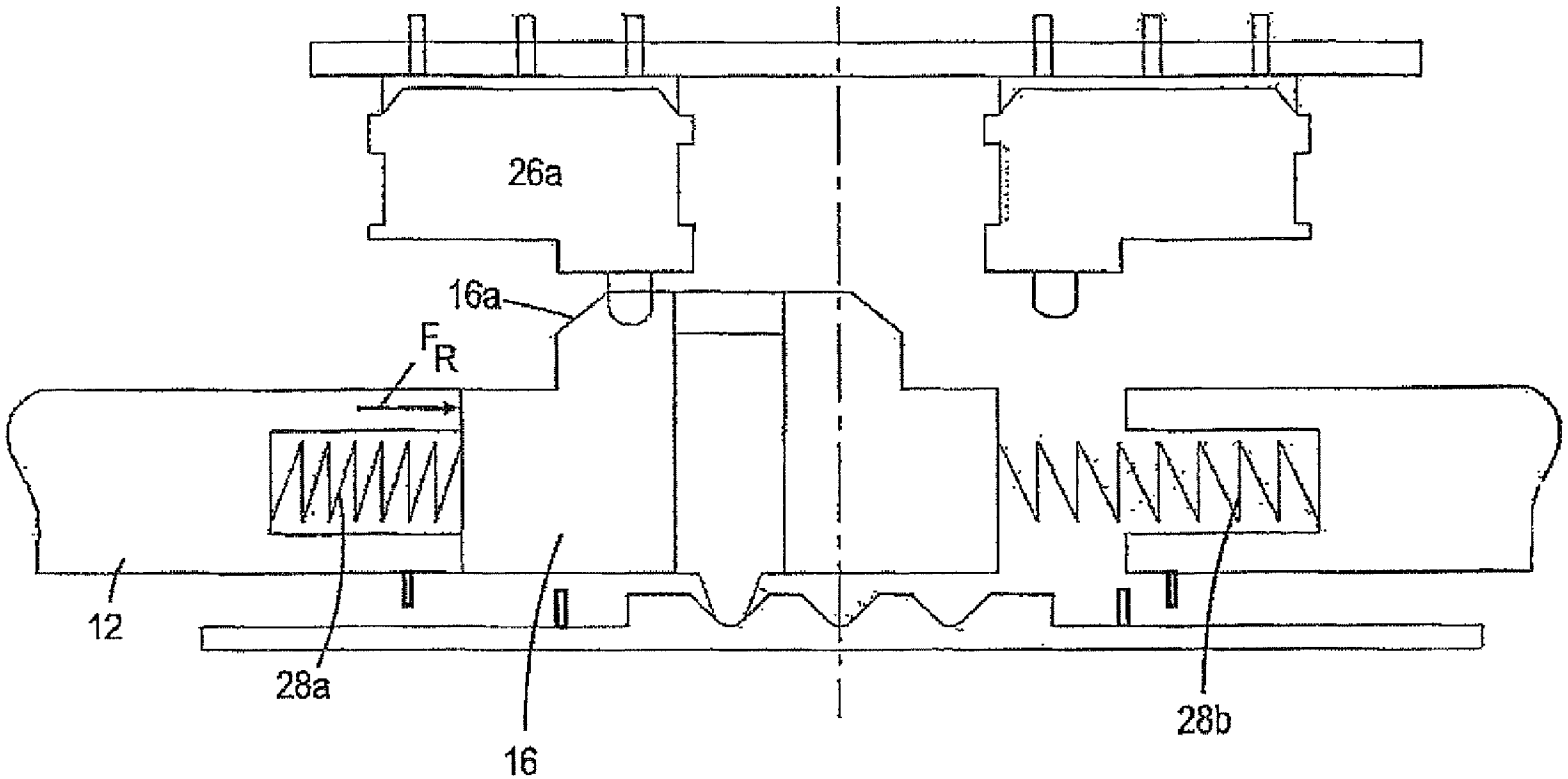
FIG. 6 shows a schematic cross-sectional side view of the redundant switch according to FIG. 1 in an actuating position after applying a resetting force.
Figure 7:
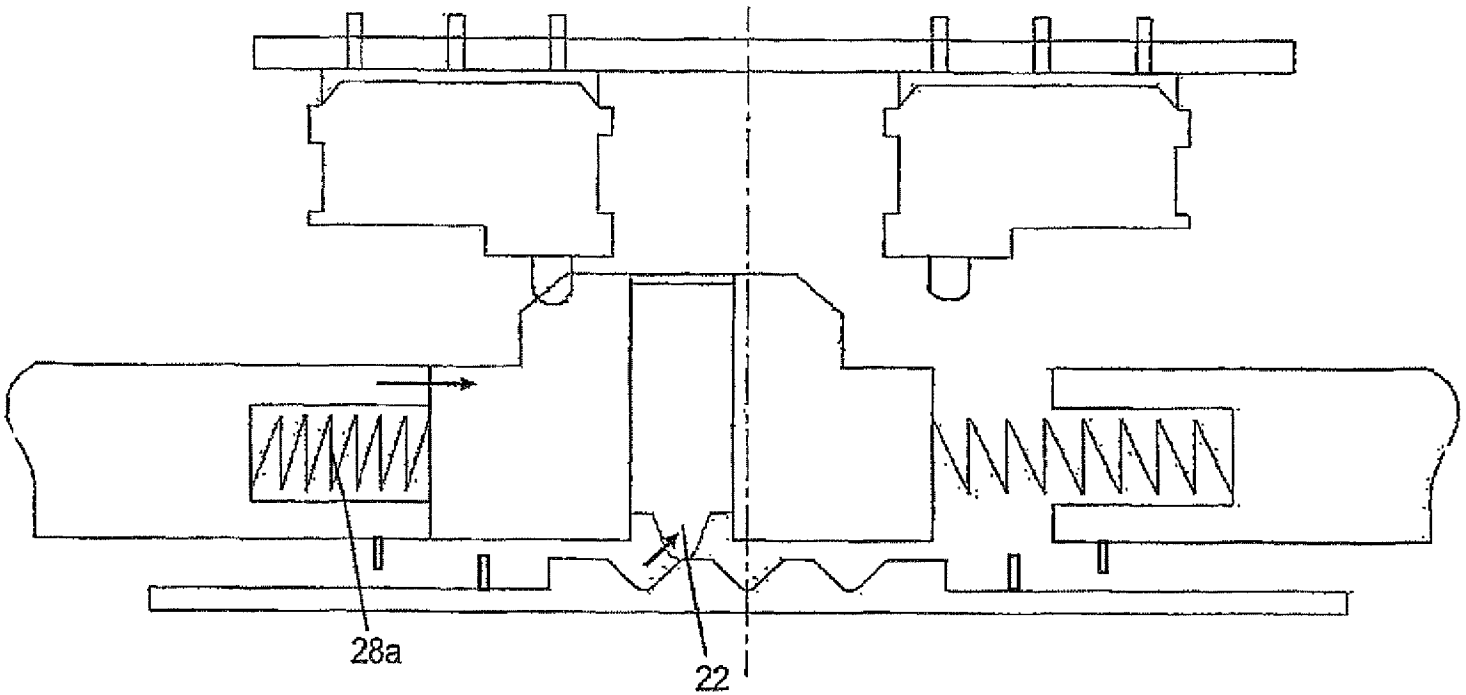
FIG. 7 shows a schematic cross-sectional side view of the redundant switch according to FIG. 1 when a slide starts to separate from actuating tappets.
Figure 8:
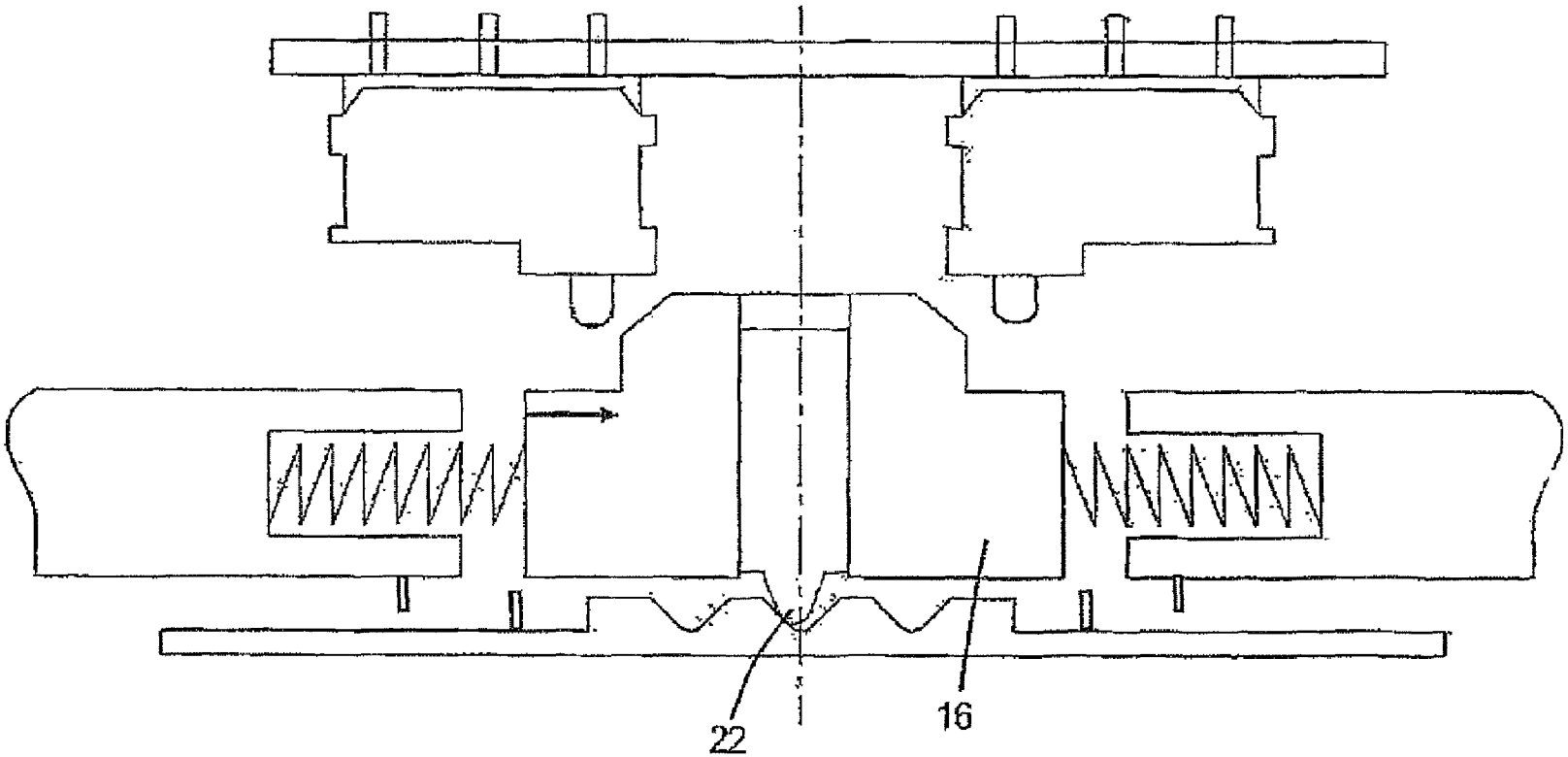
FIG. 8 shows a schematic cross-sectional side view of the redundant switch according to FIG. 1 when the cam snaps into an adjacent latching notch for the rest position.

For moving the slide 16 back into its rest position, an opposite force $F_R$ is exerted on the actuator 12, wherein first of all the compression spring 28*a* is tensioned and the compression spring 28*b* is relaxed, until the actuator 12 abuts against the slide 16, as shown in FIG. 6. Under a permanent influence of the force $F_R$, the actuator 12 directly urges the slide 16 in the direction of its rest position, wherein the latching cam 22 moves up along the ramp of the latching notch, until the flat apex surface between the adjacent latching notches is reached, as shown in FIG. 7. The further sliding movement of the slide 16 now is effected by the force of the spring 28*a* also independent of the force $F_R$. During this forced movement of the slide 16 and in the course of the sliding movement of the latching cam 22 over the planar flattened apex surface between the adjacent latching notches, the actuating ramp 16*a* of the slide 16 separates from the actuating tappets of the switch units 26*a*, which now no longer are actuated, as shown in FIG. 8. The latching cam 22 now again reaches its latching position in the middle latching notch, and the slide 16 again is in the rest position.

For actuating the switch units 26*b* proceeding from the rest position shown in FIG. 1, an actuating force is exerted on the actuator 12 in a direction opposite to the process described above. The further operation is completely symmetrical with the one described above and need therefore not be described separately.

The invention claimed is:

1. A redundant switch, comprising:

a housing, an actuator movable in the housing in two opposing translational directions, a slide movable in the housing in said two opposing translational directions and coupled to the actuator by two antagonistic springs with clearance in both directions of movement, a latching track fixed to the housing and having at least two latching notches, which are spaced from each other along the directions of movement, at least two switch units fixed to the housing and arranged one beside the other for simultaneous actuation by the slide, the switch units comprising an actuating tappet each, the slide having an actuating ramp for engaging the actuating tappets of the switch units, and a latching cam guided on the slide for movement perpendicular to said directions of movement and urged towards the latching track by a compression spring;

wherein:

a) one of the latching notches in cooperation with the latching cam defines a rest position of the slide, in which the slide does not actuate the switch units, b) another latching notch in cooperation with the latching cam defines an actuating position of the slide, in which the slide has actuated the switch units, c) said antagonistic springs force the slide to move into the respective other position, when the latching cam slides over an apex between the latching notches.

2. The switch according to claim 1, wherein the apex between the latching notches of the latching track is flattened and the position of the switch units is determined relative to the apex between the latching notches, such that the switch units are actuated when the latching cam slides over the apex between the latching notches.

3. The switch according to claim 1, comprising two groups of switch units, the units in each group being simultaneously actuated by the slide, wherein said slide has an actuating position defined by a latching notch of the latching track on either side of the rest position.

4. The switch according to claim 1, wherein the antagonistic springs are compression springs mounted in a pretensioned condition.

5. The switch according to claim 4, wherein the actuator is movable between two stops and, when moving against the slide disposed in the rest position, first compresses the one of the compression springs and relaxes the other, then abuts against the slide and forces the same to move until reaching one of the stops, wherein the latching cam then has reached the apex between adjacent latching notches.

* * * * *